US005851750A

United States Patent [19]

Furusawa et al.

[11] Patent Number: 5,851,750

[45] Date of Patent: Dec. 22, 1998

[54] SILVER HALIDE GRAIN, SILVER HALIDE EMULSION AND PREPARATION METHOD THEREOF

[75] Inventors: Naoko Furusawa; Masako Kuramoto; Kazuyoshi Ichikawa; Haruhiko Masutomi, all of Hino, Japan

[73] Assignee: Konica Corporation, Tokyo, Japan

[21] Appl. No.: 710,197

[22] Filed: Sep. 13, 1996

[30] Foreign Application Priority Data

Sep. 21, 1995 [JP] Japan ..... 7-243156

[51] Int. Cl.[6] ..... G03C 1/005; G03C 1/08

[52] U.S. Cl. ..... 430/567; 430/569; 430/599

[58] Field of Search ..... 430/567, 569, 430/599

[56] References Cited

U.S. PATENT DOCUMENTS 5,389,511 2/1995 Nakayama ..... 430/600

FOREIGN PATENT DOCUMENTS 0 454 069 A1 10/1991 European Pat. Off. .
0 541 104 A1 5/1993 European Pat. Off. .

OTHER PUBLICATIONS

S.H. Ehrlich, "Spectroscopic Studies of AGBR With Quantum–Sized Clusters of Iodide, Silver, and Silver Sulfides", (1993), pp. 73–91, Journal of Imaging Science and Technology, vol. 37, No. 1.

*Primary Examiner*—Mark F. Huff
*Attorney, Agent, or Firm*—Frishauf, Holtz, Goodman, Langer & Chick, P.C.

[57] ABSTRACT

A silver halide grain is disclosed, having one or more chemical sensitization clusters, and a largest size of the clusters being not less than 1.2 nm and less than 4.0 nm in diameter. A silver halide emulsion containing silver halide grains, as above-described and a preparation method are also disclosed.

7 Claims, 1 Drawing Sheet

FIG. 1 - a
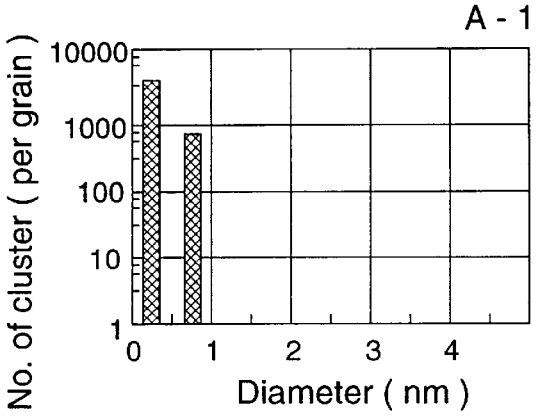
FIG. 1 - b
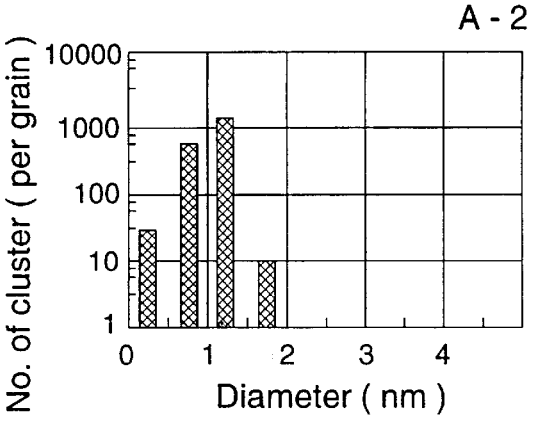
FIG. 1 - c
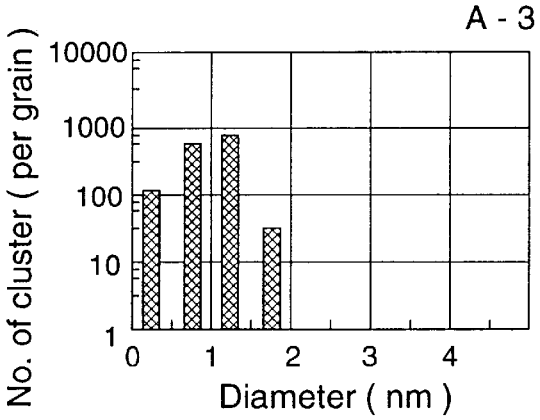
FIG. 1 - d
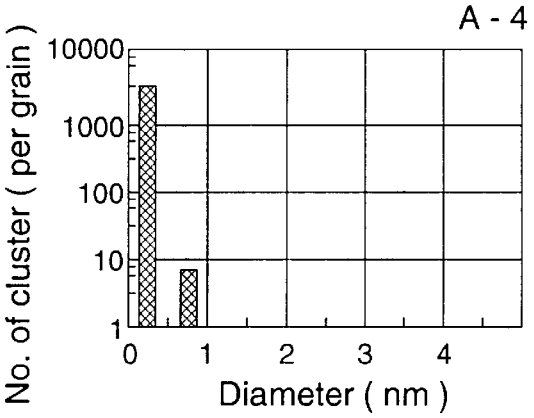
FIG. 1 - e
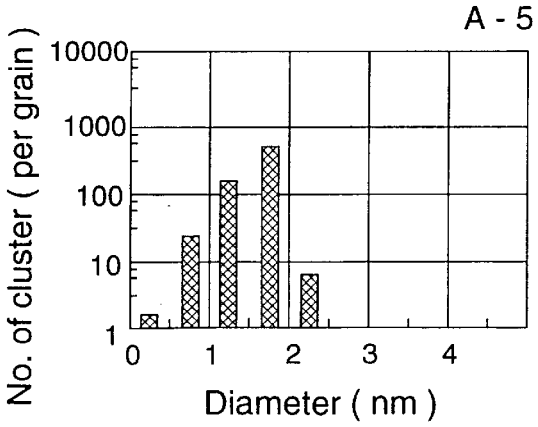

SILVER HALIDE GRAIN, SILVER HALIDE EMULSION AND PREPARATION METHOD THEREOF

FIELD OF THE INVENTION

The present invention relates to silver halide (hereinafter, denoted as AgX) grains and silver halide emulsion with high sensitivity and low fog, and a preparation method thereof.

BACKGROUND OF THE INVENTION

It is well known that a silver halide photographic emulsion is chemically sensitized with a sulfur sensitizer. Electronmicroscopic observation of silver sulfide formed in the sensitization is described in G. C. Farnell & P. B. Frint, J. Photo. Sci., Vol.25, page 203. According to their observation, many silver sulfide centers were present on the grain.

In cases of sulfur sensitization, photographic sensitivity basically depends on the forming site, number and density, size and composition of silver sulfide centers. It is necessary to control these factors to the state to achieve the highest latent image forming efficiency. As is also well known, these control factors are similar in sulfur sensitization, gold-sulfur sensitization and noble metal sensitization and there is an optimal state in combination with silver halide grains.

In most chemical sensitizing methods known in the art, however, technical means for controlling the number and size of chemical sensitization clusters are incomplete and techniques concerning the optimal size of the sensitization center is not openly disclosed.

JP-A 61-93447 (herein term "JP-A" means unexamined, published Japanese Patent Application) discloses selective growth of silver sulfide, gold sulfide and a mixture thereof. However, this only concerns control of forming sites of chemical sensitization clusters, which differs from the present invention.

JP-A 63-305343 and 64-26838 teach with respect to a development initiating site. However, the development initiating site is not related to the size of chemical sensitization cluster, so that this disclosure has no relationship to a chemical sensitizing method of the present invention, relating to the size of the chemical sensitization cluster.

There are many disclosures with regard to the forming sites of the chemical sensitization clusters, including JP-A 64-40938, 64-62631, 64-62632, 64-74540, 1-158425, 2-34 and 2-298935, which relate to limitations regarding the chemical sensitization site alone and provides no description with respect to the size of the chemical sensitization cluster, which is important in enhancement of sensitivity. Therefore, the disclosure of these is different from the chemical sensitizing method of the present invention, which relates to the size of the chemical sensitization cluster. With regard to the chemical sensitization cluster, G. C. Farnell (J. Phot. Sci. 25 203, 1977), J. C. Aznarez (ibid, 25 53, 1977) and R. Dekeyer (Paper Summaries, IS & T 44th Annual Conference, 1991) disclose observations by transmission electron microscopy (TEM) Further, S. H. Ehrlich (J. Imag. Sci. 37 73 1993), J. K. Keevert (J. Imag. Sci. 31 143 1987), H Kanzaki (J. Chem. Solids 55 [7] 631 1994) and Nakayama (Japanese Patent Application No. 3-317268) are also cited. However, these references do not teach any numerical values relating to the present invention.

The present invention intends to achieve marked enhancement of sensitivity, which could not be accomplished by the above-described development initiating sites and the site of the chemical sensitization cluster, by limiting the size of the chemical sensitization clusters.

As a result of study by the inventors of the present invention, it was revealed that a chemical sensitization cluster of a larger size is more preferable for latent image formation. On the other hand, it was further proved that, when the center size exceeded 4 nm, fog gradually increased with an increase in size of the center.

SUMMARY OF THE INVENTION

An objective of the present invention is to provide silver halide grains with low fog and high sensitivity, a silver halide emulsion and preparation method thereof.

The objective of the present invention is accomplished by the following.

(1) A silver halide grain having one or more chemical sensitization clusters, a largest size of which is not less than 1.2 nm and less than 4.0 nm, in a equivalent circular diameter of its projected area.

(2) The silver halide grain described in (1), wherein said largest size is not less than 2.5 nm and less than 4.0 nm.

(3) A silver halide emulsion comprising silver halide grains, wherein at least 50% of the total number of the grains is accounted for by silver halide grains each having one or more chemical sensitization clusters, a largest size of which is not less than 1.2 nm and less than 4.0 nm.

(4) The silver halide emulsion described in (3), wherein at least 80% of the total number of the grains is accounted for by silver halide grains each having one or more chemical sensitization clusters, a largest size of which is not less than 1.2 nm and less than 4.0 nm.

(5) The silver halide emulsion described in (3), wherein less than 1% of the total number of the grains is accounted for by silver halide grains each having one or more chemical sensitization clusters, a largest size of which is not less than 6 nm.

(6) The silver halide emulsion described in (5), wherein less than 15% of the total number of the grains is accounted for by silver halide grains each having one or more chemical sensitization clusters, a largest size of which is not less than 4 nm and less than 6 nm.

(7) A process for chemically ripening silver halide grains, wherein the silver halide grains are chemically ripened under such conditions that a relative aggregation rate constant ($\epsilon$) satisfies the following relationship so as to form chemical sensitization clusters having such a largest size as above-described, $$1.24\times10^2 \leqq \epsilon \leqq 1.53\times10^7$$

wherein $\epsilon$ is represented by the following equation, $$\epsilon = N\cdot k/(2\cdot ks)$$

where N is an addition amount of a chemical sensitizing agent, expressed in number per $\mu m^2$ of the surface of a silver halide grain; k is a aggregation rate constant ($\mu m^2$/min.), which corresponds to the collision number of a monomer constituting the chemical sensitization cluster per unit time, when one monomer per unit area is present; ks is a substantially first-order reaction rate constant (min.$^{-1}$).

(8) The process described in (7), wherein the chemical ripening is carried out at a temperature of not less than 60° C. and the rate constant (ks) is controlled by adjusting appropriately the pAg.

(9) The process described in (7), wherein the chemical ripening is carried out so as to form the chemical sensitization clusters at a specific site on the grain.

BRIEF EXPLANATION OF THE DRAWING

FIGS. 1-*a* to 1-*e* show size-frequency distribution of the chemical sensitization clusters of various sizes formed in a silver halide grain of each of emulsions A-1 to A-5.

DETAILED DESCRIPTION OF THE INVENTION

In the present invention, the term, "chemical sensitization cluster" is referred to as a cluster of reaction products formed through chemical ripening , which acts as a chemical sensitization center. Inventors of the present invention made study with respect to relationship between the size of chemical sensitization cluster and fog. As a result thereof, it was found that in cases where the size was less than 4 nm, an development-induction period of the sensitization center was the same as that of primitive emulsion fog (i.e. fog produced during the course of grain formation) and there was produced no fog due to chemical sensitization; in cases where the size exceeded 4 nm, the induction period gradually became shorter; and in cases where the size was more than 6 nm, the induction period became the same as that of a latent image with developable minimum size.

In view of the foregoing, to restrain fog produced due to chemical sensitization, it is preferable that silver halide grains having chemical sensitization clusters with a size of 6 nm or more account for less than 1% of the total number of grains and silver halide grains having chemical sensitization cluster with a size of not less than 4 nm and less than 6 nm account for less than 15% of the total number of grains; more preferably, silver halide grains having chemical sensitization cluster with a size of not less than 4 nm and less than 6 nm account for less than 5% of the total number of grains. More preferably, there is no silver halide grain having chemical sensitization cluster with a size of not less than 4 nm and less than 6 nm and in this case, a silver halide emulsion, which does not form any fog due to chemical sensitization, regardless of a developer, is to be obtained. It was further found that, when the largest size of the chemical sensitization clusters was not less than 1.2 nm and less than 4 nm, a silver halide emulsion with high sensitivity and low fog was obtained.

A chemical sensitizer can be selected from compounds containing a sulfur, selenium or tellurium atom. Sodium thiosulfate, elemental sulfur, thiourea derivatives, Rhodanine derivatives, oxazolidine derivatives, polysulfide derivatives, selenourea derivatives and dithiacarbamate derivatives are preferred and compounds having a cyclic structure are more preferred. A compound containing a VIII-group metal atom is also used in chemical ripening. As examples of the compound containing the VIII-group metal atom are cited ruthenium chloride, rhodium chloride, potassium tetrathiopalladate and potassium hexachloroaurate (VI). These sulfur, selenium, tellurium, gold and VIII-group noble metal compounds are added in any order, and if possible, sulfur, selenium or tellurium compound is added preferably at first.

Sulfur, selenium or tellurium compounds used in the invention can readily be synthesized according to the method described in Chem. Rev. 55, 181 (1955); Chem. Ber., 63, 208 (1930); J. Org. Chem., 36, 3895 (1971); J. Chem. Soc., 1957, 2999. Gold-containing compounds can be synthesized according to the method described in Bull. Chem. Soc. Japan., 48 (3), 1024–1029; J. Inorg. Nucl. Chem., 38 (1) 7–11 (1976); Transition Met. Chem., 2 (6), 224–227 (1977); JP-A 1-147537. Compounds containing a VIII-group noble metal are commercially available from Aldrich Chemical Company and Johnson Mathey Company.

In the process for chemical-ripening silver halide grains according to the invention, the silver halide grains are chemically ripened under the condition satisfying the following requirement to adjust the largest size of the chemical sensitization cluster, $$1.24\times10^2 \leqq \epsilon \leqq 1.53\times10^7$$

wherein $\epsilon$ is a relative aggregation rate constant represented by the following equation, $$\epsilon = N\cdot k/(2\cdot ks)$$

wherein N is an addition amount of a chemical sensitizer, expressed in terms of the number of molecule(s) of the chemical sensitizer per $\mu m^2$ of the surface of the silver halide grain; k is a aggregation rate constant ($\mu m^2$/min.), which corresponds to the collision number of a monomer constituting the chemical sensitization cluster per unit time (min.) ,in the case when one monomer is present per unit area; ks is a reaction rate constant, which is substantially a first-order reaction rate constant, in $(min.)^{-1}$. N, k and ks of the above equation will be explained more in detail.

Determination of ks:

Takiguchi reported the measurement of a reaction rate of a sulfur sensitizer, using radio-tracer technique J. Imag. Sci. Vol. 32 pp. 20 1988). Therefore, this method can be applied to determine ks in the invention.

Determination of N:

(1) In cases where the aggregation rate constant is single, N can be obtained from:

$$N = M_{ALL}/S_{ALL}$$

where $M_{ALL}$ is the total number of added sensitizers and $S_{ALL}$ is the total surface area of silver halide grains in which the sensitized is capable of reacting.

(2) In cases where, on the grain surface are present two or more areas different in the aggregation rate constant (for example, in case of silver halide grains having two or more different indexes of plane), N-number at each area must be determined. The N-number at area j (j=1, 2, 3, . . . ), $N_j$ can be determined from:

$$N_j = M_j/S_j$$

where $M_j$ and $S_j$ are respectively the number of added sensitizers and the surface area at area j (j=1, 2, 3, . . . ). $S_j$ can be determined from electronmicroscopic observation of the area of chemical sensitization cluster formation. $M_j$ can be determined from the number of the centers formed at area j and the size thereof, by electronmicroscopic observation of the centers. Thus, $M_j$ can be obtained from:

$$M_j = \Sigma_i\ i\cdot n_i$$

where the center comprised of sensitizers of i in number are $n_i$ in number.

Aggregation rate constant k:

The aggregation rate constant (k) is dependent of species of the chemical sensitization cluster, ripening temperature and condition of grain surface. The aggregation rate constant can be determined by observing chemical sensitization clusters with respect to the size-frequency distribution within the grain in a manner similar to Farnell and applying thereto the following aggregation rate equations.

$$c(1,\tau) = \left.\frac{dG}{dZ}\right|_{Z=0} \quad (1)$$

-continued $$N = \frac{\left[ -I_1(2\sqrt{\epsilon}\ e^{-r/2\epsilon}) + \frac{I_1(2\sqrt{\epsilon})}{K_1(2\sqrt{\epsilon})} K_1(2\sqrt{\epsilon}\ e^{-r/2\epsilon}) \right] e^{-r/2\epsilon}}{\left[ -I_0(2\sqrt{\epsilon}\ e^{r/2\epsilon}) + \frac{I_1(2\sqrt{\epsilon})}{K_1(2\sqrt{\epsilon})} K_0(2\sqrt{\epsilon}\ e^{-r/2\epsilon}) \right] \sqrt{\epsilon}} \tag{1-2}$$

$$G = \frac{-\left[ -I_1(2\sqrt{\epsilon(1-z)}\ e^{-r.2\epsilon}) + \frac{I_1[2\sqrt{\epsilon(1-z)}]}{K_1[2\sqrt{\epsilon(1-z)}]} K_1[2\sqrt{\epsilon(1-z)}\ e^{-r/2\epsilon}] \right]}{\left[ -I_0[2\sqrt{\epsilon(1-z)}\ e^{-r/2\epsilon}] + \frac{I_1[2\sqrt{\epsilon(1-z)}]}{K_1[2\sqrt{\epsilon(1-z)}]} K_0[2\sqrt{\epsilon(1-z)}\ e^{-r/2\epsilon}] \right]} \times \sqrt{\frac{1-z}{\epsilon}}\ e^{-r/2\epsilon} + N \tag{1-3}$$

$$dc(2, \tau)/d\tau = c(1, \tau)^2 - 2c(1, \tau)c(2, \tau) \tag{2}$$

$$dc(i, \tau)/d\tau = 2c(i-1, \tau)c(1, \tau) - 2c(1, \tau)c(i, \tau)\ (i \geqq 3) \tag{3}$$

and the initial condition are:

$$c(1, 0) = c(2, 0) = c(3, 0) \ldots = 0$$

where $I_n$: modified Bessel function of first kind of order n $K_n$: modified Bessel function of second kind of order n i: number of molecules constituting the center t: ripening time in min.

z: transform variable

τ: dimensionless time (kNt)/2 c(i, τ): (concentration per $\mu m^2$ of aggregates containing i monomers at time τ)/N Substituting N and ks obtained by the above-described method and an arbitrary value as k in equations (1), (2) and (3), c(i, τ) can be calculated (i=1,2,3, . . . ). Further, assuming that the chemical sensitization cluster has a density of crystal structure and is a sphere when a circle-equivalent diameter is not more than 2.35 nm and disk when the diameter is more than 2.35 nm, c(i, τ) is converted to the size-frequency distribution. The crystal structure of the center can be determined by observing lattice image of the center by high resolution transmission electron microscopy (T. Shiozawa, Paper Summaries International Symposium in Fall Conference of S.P.S.T Japan page 13). A obtained value of the aggregation rate constant is successively substituted and the calculated value which agrees with observed number of the chemical sensitization clusters having a largest size is defined as aggregation rate constant k. The relative aggreagtion rate constant is a value as a parameter included in a aggregation rate equation of Smoluchowski. The aggregation rate equation is generally applied to the aggregation of fine particles, as described in J. K. Keevert and V. V. Gokhale, J. Imaging Sci.31 243 (1987). J. K. Keevert et al analyzed aggregation of chemical sensitization clusters, using this aggregation rate equation. However, their study was within the range of alalysis under such a condition that the aggregation rate constant was negligible as an error. There was no description with regard to the effect of the relative aggregation rate constant on the population of aggregates of various sizes.

In silver halide emulsion which have been chemical-ripened in a conventional manner, the value of ε is much smaller than $1.24\times10^2$ and the size of the chemical sensitization cluster formed is less than 1.2 nm. Preferred method of enlarging ε is as follows.

(1) Ripening is conducted at 60° C. or more and a high pAg.

(2) Ripening at 60° C. or more with continuously adding a chemical sensitizer.

(3) Ripening in the presence of a silver halide solvent.

(4) Coverage of the surface of silver halide grains with a adsorbing agent.

(5) Silver halide grains with a specific site.

Chemical-ripening at a high temperature is preferred for increasing the ε value. The high temperature ripening causes the aggregation rate to increase markedly. However, the ripening at a high temperature also accelerate the reaction rate of a sensitizer so that, in the case when sufficient effects are achieved, it is necessary to restrain the reaction rate by means other than the temperature. As a method for restraining the reaction rate, it is effective to lower the silver ion concentration of the emulsion. Thus, the pAg is preferably 8.5 or more, more preferably, 9.0 or more. As another preferred method, the reaction rate can be restrained by the control of a supplying rate of the chemical sensitizer. The control of a supplying rate means that the sensitizer is separately or continuously added over a period of time. The supplying rate may be varied during addition.

To increase the aggregation rate constant (ε), the silver halide solvent may be advantageously used. According to the inventor's study, it was found that the aggregation rate became at least twice by the use of the solvent. The solvent include thiocyanates, thioethers and telluroethers. Exemplarily, KSCN, $NH_4SCN$, etc., are preferred. The solvent may be added before or concurrently with the addition of the sensitizer. The solvent is preferably added before the addition of the sensitizer.

The coverage of the surface of silver halide grains with the adsorbing agent allows to decrease the reaction area of the sensitizer and increase N, resulting in an increase in ε to enlarge the cluster. For the purpose of this, the use of a spectral sensitizing dye, azaindene or heterocyclic compound containing a mercapto group is preferred. Examples thereof include tetrazaindene and phenylmercaptotetrazole. The adsorbing agent may be added at any time before, during or after (preferably before) the addition of the sensitizer.

The term, "the specific site of the grain" is referred to as a portion of the edge and/or corner of the grain, an aggregation rate constant of which is at least 1.2 times that of faces of the grain. In cases where the grain has two or more faces different in the aggregation rate constant. the specific site portion has at least 1.2 time that of the face having the largest rate constant among the faces. The position of the specific site is dependent of a sensitizer and silver halide grain.

In the invention, the following requirement is met at a time during a period from the time of adding the sensitizer to the time of completion of the sensitizer reaction, $1.24\times10^2 \leqq \epsilon \leqq 1.53\times10^7$.

The time of meeting the requirement is determined so as to form the desired sensitization clusters with the largest size of not less than 1.2 nm and less than 4.0 nm. Thus, the time can be determined by observing the sensitization clusters to confirm the formation of the desired cluster.

The chemical sensitization cluster can be selectively grown by use of a thiourea type sensitizer represented by the following formula (1) in combination with a thiosulfate.

$$(NR_1R_2)(NR_3R_4)C{=}X \qquad \text{Formula (1)}$$

In the formula, X represents S, Se or Te; $R_1$, $R_2$, $R_3$ and $R_4$ each represents a hydrogen atom, amidino group, alkyl group, phenyl group or heterocyclic group.

Exemplary compounds represented by formula (19) are shown below, but the invention is not limited to these.

1 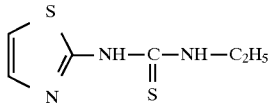

2 $(H_5C_2-NH-\underset{\underset{S}{\|}}{C}-NH-\underset{\underset{NH}{\|}}{C}-NH_2)_2.H_2CO_3$ 3 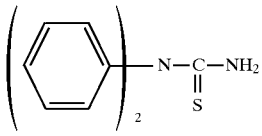

4 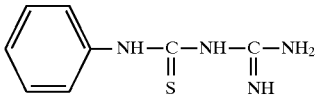

5 $H_5C_2-HN-\underset{\underset{S}{\|}}{C}-N-(C_2H_5)_2$

6 $(CH_3)_2N-\underset{\underset{Se}{\|}}{C}-NH_2$

7 $NH_2-\underset{\underset{Se}{\|}}{C}-NH_2$

8 $(CH_3)HN-\underset{\underset{Se}{\|}}{C}-NH(CH_3)$

9 $(CH_3)_2N-\underset{\underset{Se}{\|}}{C}-N(CH_3)_2$

Two sensitizers of the thiourea type sensitizer and the thiosulfate may be added at the same time or separately. It is important to add the thiourea type sensitizer before completing addition of the thiosulfate. The thiourea type sensitizer is added preferably in the presence of not less than 50% of unreacted thiosulfate and more preferably before addition of the sulfate; furthermore preferably, the thiosulfate is added after completing reaction of the thiourea type sensitizer. Variation of the ratio of the thiosulfate to the thiourea type sensitizer and timing of addition of the thiosulfate enables to form the chemical sensitization cluster with a desired size.

The thiosulfate used in the invention is represented by the following formula (2) or (3).

$$M_1^I M_2^{II} S_2O_3 \qquad \text{Formula (2)}$$

$$M^{II} S_2O_3 \qquad \text{Formula (3)}$$

In the formula, $M_1^I$ and $M_2^{II}$ each represent a univalent cation, and $M^{II}$ represents a bivalent cation. The thiosulfate compound used in the invention decomposes on the surface of silver halide to form silver sulfide. $M_1^I$ and $M_2^{II}$ each are preferably $NH_4^+$, $K^+$ or $Na^+$ (more preferably, $Na^+$) and $M^{II}$ is preferably $Ca^{2+}$.

A chemical sensitization cluster made of the compound represented by formula (1) acts as catalyst and grow up so that a chemical sensitization cluster with a size of 1.2 nm is formed in a small value of $\epsilon$. The largest size of the center can be enlarged by increasing the value of $\epsilon$. This method is a preferable for enlarging the largest size of the center; however, since the formation of a center with a size of 4 nm or more becomes easy, care must be taken.

This effect is specific in the case of using the thiourea type sensitizer and definitely distinct, as compared to the case where the thiourea type sensitizer is replaced by thiosulfate. A sulfur, selenium, tellurium or VIII group noble metal containing compounds used in the invention is preferably dissolved in water, water-miscible solvent or a mixture thereof to be added to a silver halide emulsion. A solvent-sparingly-soluble compound may be added in the form of a dispersion.

The inventive silver halide emulsion may be used in combination with non-inventive silver halide emulsion(s), of which halide composition is optional and may be, for example, silver bromide, silver iodobromide, silver iodochlorobromide, silver chlorobromide, silver chloride or a mixture thereof.

The silver halide emulsion of the invention or a non-inventive silver halide emulsion (hereinafter, referred to as emulsion used in the invention) has preferably a variation coefficient of grain size (expressed in the equation described in JP-A 59-152438) of 16% or less.

Silver halide grains used in the invention may have any shape, such as cubic, octahedral or tetradecahedral form, or sphere or tabular shape. Particularly, tabular grains having an average aspect ratio of 3 or more and two twin planes are preferable used. The average aspect ratio defined in the invention is an average value of the ratio of grain size (diameter) to grain thickness. The average grain size of silver halide grains used in the invention is preferably 0.1 to 5.0 $\mu$m, more preferably 0.15 to 3.0 $\mu$m and furthermore preferably 0.2 to 2.0 $\mu$m.

In the invention, the specific site of the grain is a portion of the edge and/or corner of the grain, an aggregation rate constant of which is at least 1.2 times that of faces of the grain. In cases where the grain has two or more faces different in the aggregation rate constant. the specific site portion has at least 1.2 time that of the face having the largest rate constant among the faces. The position of the specific site is dependent of a sensitizer and silver halide grain.

A monodispersed silver halide emulsion is excellent not only in graininess but also in sharpness in a size range small in light scattering. The monodispersed emulsion is described in JP-A 54-48521, 54-99419, 56-16124, 56-78831, U.S. Pat. No. 4,444,877, JP-A 57-182730, 58-49938, 58-37635, U.S. Pat. No. 4,446,228, JP-A 58-106532, 58-107530, 58-126531, 58-149037, 59-1094759-29243, 59-72440, 59-140443, 59-148049, 59-177535 and 59-152438.

The silver halide emulsion used in the invention is physical- ripened, chemical-ripened and spectrally sensitized. Additives used in these process are disclosed in Research Disclosure No. 17643, No. 18716 and No. 308119 (hereinafter, denoted as RD 17643, RD18716 and RD308119).

| Item | Page in RD 308119 | RD 17643 | RD 18716 |
|---|---|---|---|
| Chemical sensitizer | 996 III-A | 23 | 648 |
| Spectral sensitizer | 996 IV-A to A, B, C, D, H, I, J | 23–24 | 648–9 |
| Super-sensitizer | 996 IV-A to E, J | 23–24 | 648–9 |
| Antifoggant | 998 VI | 24–25 | 649 |
| Stabilizer | 998 VI | 24–25 | 649 |

Well-known photographic additives usable in the invention are also described in the above Rds. Relevant portions are shown as follows.

| Item | Page in RD 308119 | RD 17643 | RD 18716 |
|---|---|---|---|
| Antistaining agent | 1002 VII-I | 25 | 650 |
| Dye image stabilizer | 1002 VII-J | 25 | |
| Brightener | 998 V | 24 | |
| UV absorbent | 1003 VIII-C XIII-C | 25–26 | |
| Light absorbing agent | 1003 VIII | 25–26 | |
| Light scattering agent | 1003 VIII | | |
| Filter dye | 1003 VIII | 25–26 | |
| Binder | 1003 IX | 26 | 651 |
| Antistatic agent | 1006 XIII | 27 | 650 |
| Hardener | 1004 X | 26 | 651 |
| Plasticizer | 1006 XII | 27 | 650 |
| Lubricant | 1006 XII | 27 | 650 |
| Surfactant, coating aid | 1005 XI | 26–27 | 650 |
| Matting agent | 1007 XVI | | |
| Developing agent (included in material) | 1011 XXB | | |

Various types of couplers can be used in the invention and examples thereof are described in the above Rds. Relevant portions thereof are shown as below.

| Item | Page in RD 308119 | RD 17643 | RD 18716 |
|---|---|---|---|
| Yellow coupler | 1001 VII-D | | VIIC-G |
| Magenta coupler | 1001 VII-D | | VIIC-G |
| Cyan coupler | 1001 VII-D | | VIIC-G |
| Colored coupler | 1002 VII-G | | VIIG |
| DIR coupler | 1001 VII-F | | VIIF |
| BAR coupler | 1002 VII-F | | |
| Photographic-useful group releasing coupler | 1001 VII-F | | |
| Alkali-soluble coupler | 1001 VII-E | | |

In the invention are usable supports described in RD17643, page 28; RD17616, page 647–8; and RD308119 VII-K. A auxiliary layer, e.g., a filter layer or interlayer, as described RD308119 VII-K may be provided in the photographic material relating the invention. The photographic material may take any layer structure, such as normal layer structure, inverted layer structure or unit layer constitution, as described in RD308119 VII-K.

The photographic material relating to the invention is applicable to various types of color photographic materials, including a color negative film, color reversal film used for slide or TV, color paper, color positive film and color reversal paper.

The photographic material relating to the invention can be processed in conventional manner as described in RD17643 page 28–29, RD18716 page 615 and RD308119 XIX.

EXAMPLES

Emulsions A, B and C were prepared in the following manner.

Preparation of Emulsion A

Using a seed emulsion comprised of monodispersed cubic crystal grains having an average grain size of 0.3 μm and five solutions (a-1) to (a-5) as shown below, an emulsion A was prepared.

| (a-1) | | |
|---|---|---|
| Ossein gelatin | 102.2 | g |
| 28% ammonia aqueous solution | 155.4 | ml |
| 56% acetic acid aqueous solution | 93.2 | ml |
| Water | 9500 | ml |

-continued

| (a-2) | | |
|---|---|---|
| Seed emulsion | 0.22 | mol equivalent |
| (a-3) | | |
| Ossein gelatin | 122.5 | g |
| Potassium bromide | 1499.4 | g |
| Water | 5488.8 | ml |
| (a-4) | | |
| Silver nitrate | 1871.6 | g |
| 28% ammonia aqueous solution | 1526.6 | ml |
| Water to make | 5049.4 | ml |
| (a-5) | | |
| Potassium bromide | 400 | g |
| Water to make | 960 | ml |

To solution (a-1) at 40° C. with stirring was added solution (a-2) and the pH was adjusted to 9.00 with a 28% ammonia solution. Then, solutions (a-3) and (a-4) were simultaneously added thereto at a flow rate as shown below, while the pH and pAg each were controlled as below, using solution (a-5) and 56% acetic acid aqueous solution.

Flow rate of solutions (a-3) and (a-4):

| Flow rate of solutions (a-3) and (a-4): | | |
|---|---|---|
| | Flow rate (ml/min) | |
| Time | (a-3) | (a-4) |
| 0' | 6.40 | 6.70 |
| 14'34" | 14.00 | 14.80 |
| 31'32" | 33.80 | 35.50 |
| 42'05" | 59.00 | 60.80 |
| 58'12" | 76.50 | 74.00 |
| 60'49" | 74.10 | 75.20 |
| 76'28" | 59.90 | 61.60 |
| 101'25" | 54.80 | 56.30 |

| Grain growth condition | | | |
|---|---|---|---|
| Time | pH | Time | pAg |
| 0'00" | 9.00 | 0'00" | 8.61 |
| 17'42" | 8.96 | 42'05" | 9.21 |
| 36'27" | 8.85 | 45'13" | 9.28 |
| 65.31" | 8.45 | 62'09" | 9.70 |
| 84'32" | 8.20 | 75'40" | 9.99 |
| 101'26" | 8.00 | 76'28" | 10.01 |
| | | 101'26" | 10.21 |

The resulting emulsion was adjusted to a pAg of 10.4 and pH of 6.00 and then subjected to coagulation washing using an aqueous solution of phenycarbamate-gelatin. The emulsion was proved to be comprised of octahedral grains with an average size of 1 μm and referred to as emulsion A.

Preparation emulsion B

Using a seed emulsion comprised of monodispersed grains having an average grain size of 0.3 μm and five solutions (b-1) to (b-5) as shown below, an emulsion B was prepared.

| (b-1) | | |
|---|---|---|
| Ossein gelatin | 102.2 | g |
| 28% ammonia aqueous solution | 155.4 | ml |
| 56% acetic acid aqueous solution | 93.2 | ml |
| Water | 9500 | ml |

-continued

| | |
|---|---|
| (b-2) | |
| Seed emulsion | 0.22 mol equivalent |
| (b-3) | |
| Ossein gelatin | 120.0 g |
| Potassium bromide | 1499.4 g |
| Water | 5364.8 ml |
| (b-4) | |
| Silver nitrate | 1871.6 g |
| 28% ammonia aqueous solution | 1526.6 ml |
| Water to make | 5049.4 ml |
| (b-5) | |
| Potassium bromide | 400 g |
| Water | 960 ml |

To solution (b-1) at 40° C. with stirring was added solution (b-2) and the pH was adjusted to 9.00 with a 28% ammonia solution. Then, solutions (b-3) and (b-4) were simultaneously added thereto at a flow rate as shown below, while the pH and pAg each were controlled as below, using solution (b-5) and 56% acetic acid aqueous solution.

Flow rate of solutions (b-3) and (b-4):

| | Flow rate (ml/min) | |
|---|---|---|
| Time | (b-3) | (b-4) |
| 0' | 10.3 | 10.2 |
| 16'59" | 38.0 | 39.9 |
| 32'18" | 81.3 | 85.5 |
| 48'20" | 119.3 | 125.5 |
| 66'07" | 81.5 | 85.7 |

Grain growth condition

| Time | pH | pAg |
|---|---|---|
| 0'00" | 9.00 | 8.61 |
| 19'56" | 8.84 | 8.61 |
| 40.25 | 8.35 | 8.61 |
| 49'31" | 8.02 | 8.84 |
| 66'08" | 7.50 | 9.31 |

The resulting emulsion was adjusted to a pAg of 10.41 and pH of 6.00 and then subjected to coagulation washing using an aqueous solution of phenycarbamate-gelatin. The emulsion was proved to be comprised of tetradecahedral grains with an average size of 1 μm and referred to as emulsion B.

Preparation of Emulsion C

Using a seed emulsion comprised of monodispersed twin crystal grains having an average grain size of 0.36 μm and a distribution width of grain size (variation coefficient of grain size) of 18% and following five solutions, an emulsion was prepared.

| | |
|---|---|
| (c-1) | |
| Ossein gelatin | 97 g |
| Sodium propyleneoxy-polyethyleneoxy-disuccinate (10% methanol solution) | 10 ml |
| Seed emulsion | 0.191 mol equivalent |
| Water to make | 400 ml |
| (c-2) | |
| Silver nitrate | 233 g |
| Water to make | 1662 ml |
| (c-3) | |
| Ossein gelatin | 83.1 g |
| Potassium bromide | 131 g |
| Potassium iodide | 45.5 g |
| Water to make | 1662 ml |
| (c-4) | |
| Silver nitrate | 934 g |
| Water to make | 2749 ml |
| (c-5) | |
| Ossein gelatin | 137 g |
| Potassium bromide | 654.94 g |
| Water to make | 2749 ml |

To solution (c-1) at 75° C. with stirring were added solutions (c-2) and (c-3) by the double jet method at a linearly accelerated flow rate (an initial rate of 8.6 ml/min. and final rate of 25 ml/min), while the pAg was maintained at 8.5. Subsequently, solutions (c-4) and (c-5) were added by the double jet method at a linearly accelerated flow rate (an initial rate of 15 ml/min. and final rate of 34 ml/min), while the pAg was maintained at 9.0. During addition of solutions of (c-2), (c-3), (c-4) and (c-5), the pH was maintained at 3.0. After the addition, the pH was adjusted to 6.0 with potassium hydroxide aqueous solution. The emulsion was subjected to coagulation washing to remove soluble salts using an aqueous solution of Demol (product by Kao-Atlas) and magnesium sulfate aqueous solution to obtain an emulsion with a pAg of 8.5 and pH of 5.85 at 40° C. Electronmicroscopic observation revealed that the resulting emulsion comprised tabular grains accounting for 90% of the total grain projected area and having an average size (circular-equivalent diameter) of 1.5 μm and an average aspect ratio of 5.0.

Example 1

Emulsion A-1

The pAg of emulsion A was adjusted to 8.0 at 40° C. and the emulsion was ripened at a temperature of 55° C. Thus, to the emulsion was added $1.3\times10^{-6}$ mol/mol AgX of sodium thiosulfate all at once, after 120 min. ripening, chloroauric acid of $2.8\times10^{-7}$ mol/mol AgX and ammonium thiocyanate of $2.0\times10^{-5}$ mol/mol AgX were added thereto and the emulsion was ripened further for 60 min. The resulting emulsion was referred to as A-1.

Emulsion A-2

The pAg of emulsion A was adjusted to 9.5 at 40° C. and the emulsion was ripened at a temperature of 75° C. Thus, to the emulsion, sodium thiosulfate of the same amount as A-1 was added all at once; after 120 min., chloroauric acid and ammonium thiocyanate were added each in the same amount as A-1 and the emulsion was ripened further for 60 min. The resulting emulsion was referred to as A-2.

Emulsion A-3

The pAg of emulsion A was adjusted to 8.0 at 40° C. and the emulsion was ripened at a temperature of 75° C. Thus, to the emulsion, sodium thiosulfate of the same amount as A-1 was added at a given rate for 30 min.; after 120 min., chloroauric acid and ammonium thiocyanate were added each in the same amount as A-1 and the emulsion was ripened further for 60 min. The resulting emulsion was referred to as A-3.

Emulsion A-4

The pAg of emulsion A was adjusted to 8.0 at 40° C. and the emulsion was ripened at a temperature of 55° C. Thus, to the emulsion was added $6.5\times10^{-7}$ mol/mol AgX of 1-ethyl-3-(2-thiazolyl)-thiourea all at once; after 120 min. ripening, chloroauric acid and ammonium thiocyanate were added thereto in the same amount as A-1 and the emulsion was further ripened for 60 min. The resulting emulsion was referred to as A-4.

Emulsion A-5

Emulsion A-5 was prepared in the same manner as in A-3, except that sodium thiosulfate was replaced by 1-ethyl-3-(2-thiazolyl)-thiourea in the same amount as in A-4.

Thus prepared emulsions A-1 through A-5 were summarized, as below, with respect to the condition of chemical ripening.

| Emulsion | Sensitizer (Add, time) | Temperature (°C.) | pAg (40° C.) |
|---|---|---|---|
| A-1 | Hypo* (all at once) | 55 | 8.0 |
| A-2 | Hypo (all at once) | 75 | 9.5 |
| A-3 | Hypo (30 min.) | 75 | 8.0 |
| A-4 | ETTU** (all at once) | 55 | 8.0 |
| A-5 | ETTU (30 min.) | 75 | 8.0 |

*: Sodium thiosulfate

**: 1-Ethyl-3-(2-thiazolyl)-thiourea

These emulsions each were spectrally sensitized with sensitizing dyes SD-6, 7 and 8, in combination.

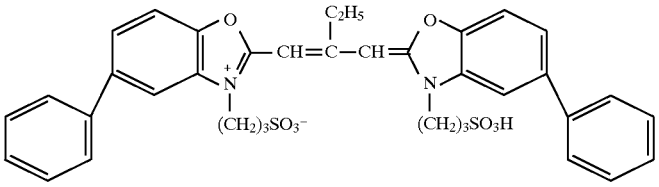

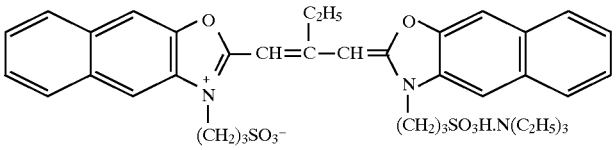

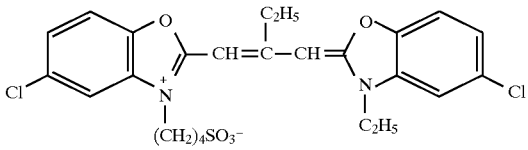

According to the method of G. C. Farnell , the gelatin shell was observed by TEM. The population of the chemical sensitization clusters of various sizes formed on the surface of the grain was measured with respect to the representative grain of each emulsions A-1 through A-5, as shown in FIG. 1, in which the size was expressed in terms of a circular-equivalent diameter. The size-frequency distribution of the centers with a largest size are shown below. Measurements thereof were made with respect to 100 grains of each emulsion

| | 0~0.5 (nm) | 0.5~ 1.2 | 1.2~ 1.5 | 1.5~ 2.0 | 2.0~ 2.5 | 2.5~ 3.0 | 3.0~ 3.5 | 4.0~ |
|---|---|---|---|---|---|---|---|---|
| A-1 | 4 (%) | 96 | — | — | — | — | — | — |
| A-2 | — | 3 | 9 | 83 | 5 | — | — | — |
| A-3 | — | 4 | 6 | 16 | 70 | 4 | — | — |
| A-4 | 12 | 88 | — | — | — | — | — | — |
| A-5 | — | 1 | 8 | 12 | 73 | 6 | — | — |

As can be seen from the above, with regard to emulsion A-1, for example, it was shown to be comprised of 4 grains having the largest size of not less than 0 nm and less than 0.5 nm and 96 grains having the largest size of not less than 0.5 and less than 1.2 nm. There was no grain having the largest size of not less than 4.0 nm. It was further shown from the electronmicrographic observation that chemical sensitization clusters of emulsion A-1, A-2 or A-3 were present overall on the surface of the grain and, in contrast, the centers of A-4 or A-5 localized in the vicinity of the edge of the grain, accounting for 30% of the total surface area.

According to the manner afore-described, the relative aggregation rate constant (ϵ) of the emulsions A-1 to A-5 was determined. Thus, the reaction rate constant (ks) of the sensitizer was determined according to the method of Takiguchi afore-described. In the case when the sensitizer was added over a given period of time, the rate constant was determined from the time necessary for 95% of the sensitizer to complete the reaction.

| Relative aggregation rate constant (ϵ) | |
|---|---|
| A-1: | $1.028 \times 10^2$ |
| A-2: | $5.710 \times 10^2$ |
| A-3: | $8.840 \times 10^2$ |
| A-4: | $1.383 \times 10$ |
| A-5: | $2.949 \times 10^3$ |

To each of the emulsions A-1 through A-5 were added magenta couplers M-1, M-3 and CM-1. Further thereto, an optimal amount of 2-hydroxy-4,6-dichlorotriazine sodium salt was added and the resulting emulsion was coated, on a subbed triacetate base support, in such an amount that silver coverage was 2.0 g/m$^2$ to prepare a photographic material sample.

These samples were exposed through an optical wedge to green light, processed according to the following color processing steps and evaluated with respect to photographic performance.

| Processing step | (Processing temp. 38° C.) | Processing time |
|---|---|---|
| Color developing | | 3 min. 15 sec. |
| Bleaching | | 6 min. 30 sec. |
| Washing | | 3 min. 15 sec. |
| Fixing | | 6 min. 30 sec/ |
| Washing | | 3 min. 15 sec. |
| Stabilizing | | 1 min. 30 sec. |
| Drying | | |

A processing solution used in each step was as follows.

Color developer

| Color developer | |
|---|---|
| 4-Amino-3-methyl-N-ethyl-N-β-hydroxy-ethylaniline sulfate | 4.75 g |
| Sodium sulfite anhydride | 4.25 g |
| Hydroxylamine 1/2 sulfate | 2.0 g |
| Potassium carbonate anhydride | 37.5 g |
| Sodium bromide | 1.3 g |
| Trisodium nitrilotriacetate (monohydrate) | 2.5 g |
| Potassium hydroxide | 1.0 g |
| Water to make | 1 liter |
| The pH was adjusted to 10.6. | |
| Bleach | |
| Ammonium ethylenediaminetetraacetate iron salt | 100.0 g |
| Ammonium ethylenediaminetetraacetate | 10.0 g |
| ammonium bromide | 150 g |
| Glacial acetic acid | 10.0 g |
| Water to make 1 liter | |
| The pH was adjusted to 6.0 with aqueous ammonia solution. | |
| Fixer | |
| Ammonium thiosulfate | 175.0 g |
| Sodium sulfite anhydride | 8.6 g |
| Sodium metasulfite | 2.3 g |
| Water to make | 1 liter |
| The pH was adjusted to 6.0. | |
| Stabilizer | |
| Formaline (37% aqueous solution) | 1.5 ml |
| Koniducks (product by Konica Corp.) | 7.5 ml |
| Water to make | 1 liter |

Results thereof are shown as below. The density was measured using green light. The sensitivity was defined as reciprocal of exposure that gave a density of fog plus 0.1 and shown as a relative value, based on the sensitivity if emulsion A-1 being 100.

| Emulsion | Sensitivity | Fog | Remark |
|---|---|---|---|
| A-1 | 100 | 0.08 | Comp. |
| A-2 | 110 | 0.09 | Inv. |
| A-3 | 120 | 0.08 | Inv. |
| A-4 | 90 | 0.08 | Comp. |
| A-5 | 135 | 0.09 | Inv. |

As can be seen from these results, according to the present invention, an emulsion with high sensitivity and low fog, in which silver sulfide centers having the largest size of less than 4 nm were selectively formed was obtained.

Example 2

Emulsion B-1

The pAg of emulsion B was adjusted to 8.0 at 40° C. and the emulsion was ripened at a temperature of 55° C. Thus, to the emulsion was added $2.6\times10^{-6}$ mol/mol AgX of sodium thiosulfate all at once, after 120 min. ripening, chloroauric acid of $2.8\times10^{-7}$ mol/mol AgX and ammonium thiocyanate of $2.0\times10^{-5}$ mol/mol AgX were added thereto and the emulsion was ripened further for 60 min. The resulting emulsion was referred to as B-1.

Emulsion B-2

The pAg of emulsion B was adjusted to 9.5 at 40° C. and the emulsion was ripened at a temperature of 75° C. Thus, to the emulsion, sodium thiosulfate of the same amount as B-1 was added all at once; after 120 min., chloroauric acid and ammonium thiocyanate were added each in the same amount as B-1 and the emulsion was ripened further for 60 min. The resulting emulsion was referred to as B-2.

Emulsion B-3

The pAg of emulsion B was adjusted to 9.5 at 40° C. and the emulsion was ripened at a temperature of 75° C. Thus, to the emulsion, sodium thiosulfate of the same amount as B-1 was added at a given rate for 60 min.; after 120 min., chloroauric acid and ammonium thiocyanate were added each in the same amount as B-1 and the emulsion was ripened further for 60 min. The resulting emulsion was referred to as B-3.

Emulsion B-4

The pAg of emulsion B was adjusted to 9.5 at 40° C. and the emulsion was ripened at a temperature of 75° C. Thus, to the emulsion, sodium thiosulfate of the same amount as B-1 was added at a given rate for 120 min.; after 120 min., chloroauric acid and ammonium thiocyanate were added each in the same amount as B-1 and the emulsion was ripened further for 60 min. The resulting emulsion was referred to as B-4.

The prepared emulsions B-1 through B-4 were summarized, as below, with respect to the condition of chemical ripening.

| EMU-sin | Sensitizer (Add, time) | Temperatrue (°C.) | pAg (40° C.) |
|---|---|---|---|
| B-1 | Hypo* (all at once) | 55 | 8.0 |
| B-2 | Hypo (all at once) | 75 | 9.5 |
| B-3 | Hypo (60 min.) | 75 | 9.5 |
| B-4 | Hypo (120 min.) | 75 | 9.5 |

*: Sodium thiosulfate

The relative aggregation rate constants of the emulsion B-1 to B-4 were determined in a manner similar to Example 1.

| Relative aggregation rate constant (ϵ) | |
|---|---|
| B-1: | $1.10\times10^{2}$ |
| B-2: | $8.74\times10^{6}$ |
| B-3: | $1.24\times10^{7}$ |
| B-4: | $1.74\times10^{7}$ |

The size-frequency distribution of the largest size of the chemical sensitization clusters formed in the grain were measured with respect to emulsion grains of B-1 to B-4, in a manner similar to Example 1. Results thereof are as follows.

| | 0~1.2 (nm) | 1.2~4.0 | 4.0~6.0 | 6.0~ |
|---|---|---|---|---|
| B-1 | 100 | — | — | — |
| B-2 | 9 | 89 | 2 | — |
| B-3 | 7 | 85 | 8 | — |
| B-4 | 3 | 26 | 63 | 8 |

These emulsions each were spectrally sensitized with the sensitizing dyes SD-6, 7 and 8, in combination.

To each of the emulsions B-1 to B-4 were added magenta couplers M-1, M-3 and CM-1. Further thereto, an optimal amount of 2-hydroxy-4,6-dichlorotriazine sodium salt was added and the resulting emulsion was coated, on a subbed triacetate base support, in such an amount that silver coverage was 2.0 g/m$^2$ to prepare a photographic material sample. These samples were exposed through an optical wedge to green light, processed according to the following color processing steps and evaluated with respect to photographic performance in the same manner as in Example 1.

The results thereof are shown as below. The sensitivity and fog were shown in a manner similar to Example 1. The sensitivity was shown as a relative value, based on the sensitivity of B-1 being 100.

| Emulsion | Sensitivity | Fog | Remark |
|---|---|---|---|
| B-1 | 100 | 0.08 | Comp. |
| B-2 | 110 | 0.09 | Inv. |
| B-3 | 135 | 0.12 | Inv. |
| B-4 | 95 | 0.43 | Comp. |

As can be seen from these results, an emulsion with high sensitivity and low fog, in which silver sulfide centers having the size of less than 4 nm were selectively formed was obtained.

Example 3

Emulsion C-1

The pAg of emulsion C was adjusted to 8.0 at 405° C. and the emulsion was ripened by adding sensitizing dyes SD-6, 7 and 8 at 55° C. At 10 min. after the start of ripening, sodium thiosulfate of $1.3\times10^{-6}$ mol/mol AgX was thereto added all at once and the emulsion was further ripened. After 120 min., chloroauric acid of $2.8\times10^{-7}$ mol/mol AgX and ammonium thiocyanate of $2.0\times10^{-5}$ mol/mol AgX were added and the ripening was further continued for 60 min. The resulting emulsion was referred to as emulsion C-1.

Emulsion C-2

The pAg of emulsion C was adjusted to 9.5 at 40° C., the emulsion was ripened by adding sensitizing dyes SD-6, 7 and 8 at 55° C. At 10 min. after the start of ripening, the temperature was raised to 75° C., then sodium thiosulfate of the same amount as in C-1 was thereto added all at once and the emulsion was further ripened. After 120 min., chloroauric acid and ammonium thiocyanate were added in the same amount as in C-1 and the ripening was further continued for 60 min. The resulting emulsion was referred to as emulsion C-2.

Emulsion C-3

The pAg of emulsion C was adjusted to 8.0 at 40° C., the emulsion was ripened by adding sensitizing dyes SD-6, 7 and 8 at 55° C. At 10 min. after the start of ripening, the temperature was raised to 75° C., then sodium thiosulfate of $1.3\times10^{-6}$ mol/mol AgX of the same amount as in C-1 was thereto added at a constant flow rate for 30 min. After 120 min., chloroauric acid and ammonium thiocyanate were added in the same amount as in C-1 and the ripening was further continued for 60 min. The resulting emulsion was referred to as emulsion C-3.

Emulsion C-4

The pAg of emulsion C was adjusted to 8.0 at 40° C. and potassium thiocyanate of $1.0\times10^{-3}$ mol/mol AgX was added. The emulsion was ripened by adding sensitizing dyes SD-6, 7 and 8 at 55° C. At 10 min. after the start of ripening, sodium thiosulfate of $1.3\times10^{-6}$ mol/mol AgX was thereto all at once and the emulsion was further ripened. After 120 min., chloroauric acid of $2.8\times10^{-7}$ mol/mol AgX and ammonium thiocyanate were added and the ripening was further continued for 60 min. The resulting emulsion was referred to as emulsion C-4.

Emulsion C-5

The pAg of the emulsion C was adjusted to 8.0 at 40° C. and the emulsion was ripened at 55° C. by adding 4-hydroxy-1,3,3a,7-tetrazaindene of $5.0\times10^{-4}$ mol/mol AgX and further sensitizing dyes SD-6, 7 and 8. At 10 min. after the start of ripening was added sodium thiosulfate of $1.3\times10^{-6}$ mol/mol AgX all at once. After 120 min., chloroauric acid of $2.8\times10^{-7}$ mol/mol AgX and ammonium thiocyanate were added and the ripening was further continued for 60 min. The resulting emulsion was referred to as C-5.

Emulsion C-6

The pAg of the emulsion C adjusted to 8.0 at 40° C., the emulsion was ripened by adding sensitizing dye SD-6,7 and 8 at 55° C. At 10 min. after the start of ripening was added 1-ethyl-3-(2-thiazolyl)-thiourea of $6.5\times10^{-7}$ mol/mol AgX all at one and after 30 min. ripening, sodium thiosulfate of $6.5\times10^{-7}$ mol/mol AgX was added all at once. After 120 min., chloroauric acid of $2.8\times10^{-7}$ mol/mol AgX and ammonium thiocyanate were added and the ripening was continued further for 60 min. The resulting emulsion was referred to as emulsion C-6.

Emulsion C-7

The pAg of the emulsion C adjusted to 8.0 at 40° C., the emulsion was ripened by adding sensitizing dye SD-6,7 and 8 at 55° C. At 10 min. after the start of ripening was added 1-ethyl-3-(2-thiazolyl)-thiourea of $6.5\times10^{-7}$ mol/mol AgX all at one and after 30 min. ripening, the temperature was varied to 75° C. Sodium thiosulfate of $6.5\times10^{-7}$ mol/mol AgX was added at a constant flow rate over a period of 120 min., then, chloroauric acid of $2.8\times10^{-7}$ mol/mol AgX and ammonium thiocyanate were added and the ripening was continued further for 60 min. The resulting emulsion was referred to as emulsion C-7.

Emulsion C-8

Emulsion c-8 was prepared in the same manner as C-7, except that 1-ethyl-3-(2-thiazolyl)-thiourea was replaced by 1,1',3-triethyl-thiourea.

Emulsion C-9

The pAg of the emulsion C adjusted to 8.0 at 40° C., the emulsion was ripened by adding sensitizing dye SD-6,7 and 8 at 55° C. At 10 min. after the start of ripening, the temperature was increased to 75° C. and was added 1-ethyl-3-(2-thiazolyl)-thiourea of $6.5\times10^{-7}$ mol/mol AgX was added at a constant flow rate for 30 min. After 10 min. ripening, sodium thiosulfate of $6.5\times10^{-7}$ mol/mol AgX was added at a constant flow rate over a period of 120 min. At 30 min. after completing the addition, chloroauric acid of $2.8\times10^{-7}$ mol/mol AgX and ammonium thiocyanate were added and the ripening was continued further for 60 min. The resulting emulsion was referred to as emulsion C-9.

Electronmicroscopic observation of the chemical sensitization clusters formed on the surface of the grain was made in a manner similar to Example 1, with respect to 200 grains of each of the emulsions C-1 to C-9. Size-frequency distribution of the largest size of the centers was determined , as shown below.

| | 0~1.2 (nm) | 1.2~4.0 | 4.0~6.0 | 6.0~ | Av. value (nm)* | Remark |
|---|---|---|---|---|---|---|
| C-1 | 100 (%) | — | — | — | 1.10 | Comp. |
| C-2 | 27 | 72 | 1 | — | 1.62 | Inv. |
| C-3 | 12 | 85 | 3 | — | 2.03 | Inv. |
| C-4 | 7 | 88 | 5 | — | 2.24 | Inv. |
| C-5 | 14 | 74 | 2 | — | 1.98 | Inv. |
| C-6 | 16 | 80 | 4 | — | 2.95 | Inv. |
| C-7 | 2 | 88 | 10 | — | 3.13 | Inv. |
| C-8 | 1 | 87 | 12 | — | 3.32 | Inv. |
| C-9 | — | 80 | 15 | 5 | 3.63 | Comp. |

*: Average size of the centers with a largest size

As can be seen from these results, an emulsion, in which silver sulfide centers having the largest size of less than 4 nm were selectively formed was obtained.

To each of the emulsions were added magenta couplers M-1, M-3 and CM-1 and the resulting emulsions each were used in the 9th layer of a color photographic light sensitive material, as shown below. Thus, a color photographic material sample No. 101 was prepared according to the following layer arrangement, provided that the addition amount of each compound was denoted as g per $m^2$, the amount of AgX and colloidal silver were converted to that of silver and the addition amount of the sensitizing dye was denoted as mol per mol of AgX.

Sample 101:

| | |
|---|---|
| 1st layer; Antihalation layer (HC-1) | |
| Black colloidal silver | 0.2 |
| UV absorbent (UV-1) | 0.23 |
| High boiling solvent (Oil-1: dioctyl phthalate) | 0.18 |
| Gelatin | 1.4 |
| 2nd layer; Interlayer )IL-1) | |
| Gelatin | 1.3 |
| 3rd layer; Low speed red-sensitive emulsion layer (RL) | |
| Silver iodobromide emulsion | 1.0 |
| (grain size, 0.40 μm and average iodide content, 8.0 mol %) | |
| Sensitizing dye (SD-1) | $1.8 \times 10^{-5}$ |
| Sensitizing dye (SD-2) | $2.8 \times 10^{-4}$ |
| Sensitizing dye (SD-3) | $3.0 \times 10^{-4}$ |
| Cyan coupler (C-1) | 0.70 |
| Colored cyan coupler (CC-1) | 0.066 |
| DIR compound (D-1) | 0.03 |
| DIR compound (D-3) | 0.01 |
| High boiling solvent (Oil-1) | 0.64 |
| Gelatin | 1.2 |
| 4th layer; Medium speed re-sensitive emulsion layer (RM) | |
| Silver iodobromide emulsion | 0.8 |
| (grain size, 0.70 μm and average iodide content, 8.0 mol %) | |
| Sensitizing dye (SD-1) | $2.1 \times 10^{-5}$ |
| Sensitizing dye (SD-2) | $1.9 \times 10^{-4}$ |
| Sensitizing dye (SD-3) | $1.9 \times 10^{-4}$ |
| Cyan coupler (C-1) | 0.28 |
| Colored cyan coupler (CC-1) | 0.027 |
| DIR compound (D-1) | 0.01 |
| High boiling solvent (Oil-1) | 0.26 |
| Gelatin | 0.6 |
| 5th layer; High speed red-sensitive emulsion layer | |
| Silver iodobromide emulsion (Emulsion C) | 1.7 |
| Sensitizing dye (SD-1) | $1.9 \times 10^{-5}$ |
| Sensitizing dye (SD-2) | $1.7 \times 10^{-4}$ |
| Sensitizing dye (SD-3) | $1.7 \times 10^{-4}$ |
| Cyan coupler (C-1) | 0.05 |

-continued

| | |
|---|---|
| Cyan coupler (C-2) | 0.10 |
| Colored cyan coupler (CC-1) | 0.02 |
| DIR compound (D-1) | 0.025 |
| High boiling solvent (Oil-1) | 0.17 |
| Gelatin | 1.2 |
| 6th layer; Interlayer (IL-2) | |
| Gelatin | 0.8 |
| 7th layer; Low speed green-sensitive emulsion layer (GL) | |
| Silver iodobromide emulsion | 1.1 |
| (grain size, 0.40 μm and average iodide content, 8.0 mol %) | |
| Sensitizing dye (SD-4) | $6.8 \times 10^{-5}$ |
| Sensitizing dye (SD-5) | $6.2 \times 10^{-4}$ |
| Magenta coupler (M-1) | 0.54 |
| Magenta coupler (M-2) | 0.19 |
| Colored magenta coupler (CM-1) | 0.06 |
| DIR compound (D-2) | 0.017 |
| DIR compound (D-3) | 0.01 |
| High boiling solvent | 0.81 |
| (Oil-2, tricresyl phosphate) | |
| Gelatin | 1.8 |
| 8th layer; Medium speed green-sensitive emulsion layer (GM) | |
| Silver iodobromide emulsion | 0.7 |
| (grain size, 0.70 μm and average iodide content, 8:0 mol %) | |
| Sensitizing dye (SD-6) | $1.9 \times 10^{-4}$ |
| Sensitizing dye (SD-7) | $1.2 \times 10^{-4}$ |
| Sensitizing dye (SD-8) | $1.5 \times 10^{-5}$ |
| Magenta coupler (M-1) | 0.07 |
| Magenta coupler (M-2) | 0.03 |
| Colored magenta coupler (CM-1) | 0.04 |
| DIR compound (D-2) | 0.018 |
| High boiling solvent (Oil-2) | 0.30 |
| Gelatin | 0.8 |
| 9th layer; High speed green-sensitive emulsion layer (GH) | |
| Silver iodobromide emulsion (Emulsion C-1) | 1.7 |
| Sensitizing dye (SD-6) | $1.2 \times 10^{-4}$ |
| Sensitizing dye (SD-7) | $1.0 \times 10^{-4}$ |
| Sensitizing dye (SD-8) | $3.4 \times 10^{-6}$ |
| Magenta coupler (M-1) | 0.09 |
| Magenta coupler (M-3) | 0.04 |
| Colored magenta coupler (CM-1) | 0.04 |
| High boiling solvent (Oil-2) | 0.31 |
| Gelatin | 1.2 |
| 10th layer; Yellow filter layer (YC) | |
| Yellow colloidal silver | 0.05 |
| Anti-staining agent (SC-1) | 0.01 |
| High boiling solvent (Oil-2) | 0.13 |
| Gelatin | 0.7 |
| Formalin scavenger (HS-1: 5-ureidohydantoin) | 0.09 |
| Formalin scavenger (HS-2: hydantoin) | 0.07 |
| 11th layer; Low speed blue-sensitive emulsion layer (BL) | |
| Silver iodobromide emulsion | 0.5 |
| (grain size, 0.40 μm and average iodide content, 8.0 mol %) | |
| Silver iodobromide emulsion | 0.5 |
| (grain size, 0.70 μm and average iodide content, 8.0 mol %) | |
| Sensitizing dye (SD-9) | $5.2 \times 10^{-4}$ |
| Sensitizing dye (SD-10) | $1.9 \times 10^{-5}$ |
| Yellow coupler (Y-1) | 0.65 |
| Yellow coupler (Y-2) | 0.24 |
| DIR compound (D-2) | 0.03 |
| High boiling solvent (Oil-2) | 0.18 |
| Gelatin | 1.3 |
| Formalin scavenger (HS-2) | 0.08 |
| 12th layer; High speed blue-sensitive emulsion layer (BH) | |
| Silver iodobromide emulsion (Emulsion C) | 1.0 |
| Sensitizing dye (SD-9) | $1.8 \times 10^{-4}$ |
| Sensitizing dye (SD-10) | $7.9 \times 10^{-5}$ |
| Yellow coupler (Y-1) | 0.15 |
| Yellow coupler (Y-2) | 0.05 |
| High boiling solvent (Oil-2) | 0.074 |
| Gelatin | 1.3 |
| Formalin scavenger (HS-1) | 0.05 |
| Formalin scavenger (HS-2) | 0.12 |

-continued

| 13th layer; First protective layer (Pro-1) | |
|---|---|
| Silver iodobromide fine grain emulsion (grain size, 0.08 μm and average iodide content, 1.0 mol %) | 0.4 |
| UV absorbent (UV-1) | 0.07 |
| UV absorbent (UV-2) | 0.10 |
| High boiling solvent (Oil-1) | 0.07 |
| High boiling solvent (Oil-3: dibutylphthalate) | 0.07 |
| Formalin scavenger (HS-1) | 0.13 |
| Formalin scavenger (HS-2) | 0.37 |
| Gelatin | 1.3 |

-continued

| 14th layer; Second protective layer (Pro-2) | |
|---|---|
| Alkali soluble matting agent (av. size: 2 μm) | 0.13 |
| Polymethyl methaacrylate (av. size: 3 μm) | 0.02 |
| Slipping agent (Wax-1) | 0.04 |
| Gelatin | 0.6 |

Samples 102 to 109 were prepared in the same manner as Sample 101, except that emulsion C-1 was replaced by emulsion C-2, 3, 4, 5, 6, 7, 8 or 9.

C-1

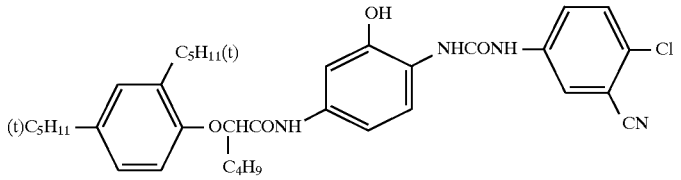

C-2

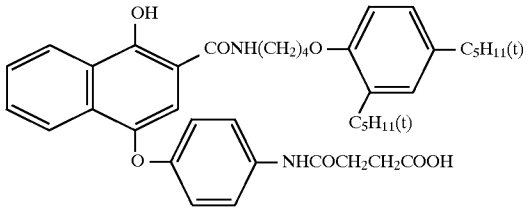

M-1

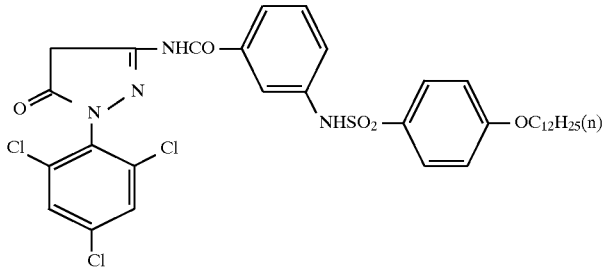

M-2

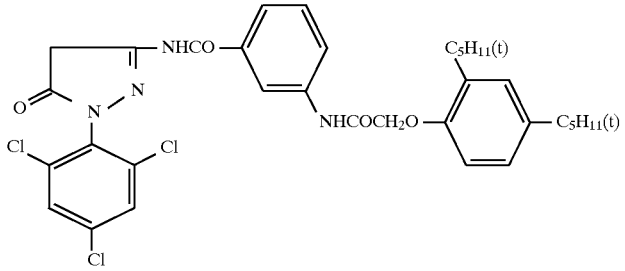

M-3

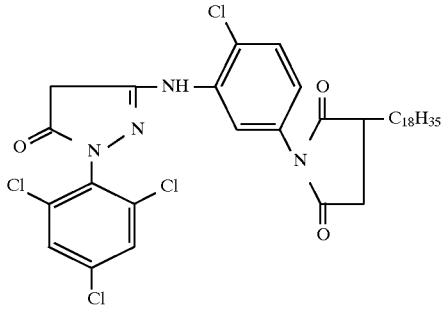

-continued
Y-1
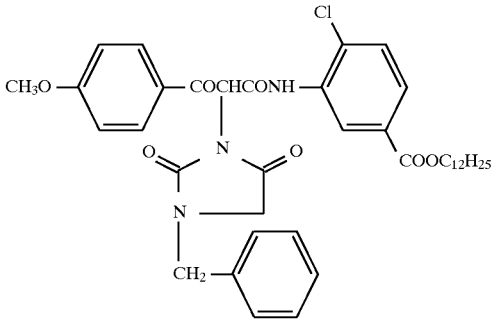
Y-2
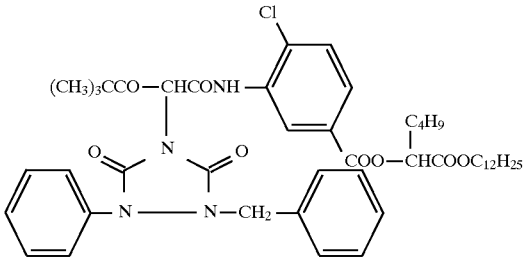
CC-1
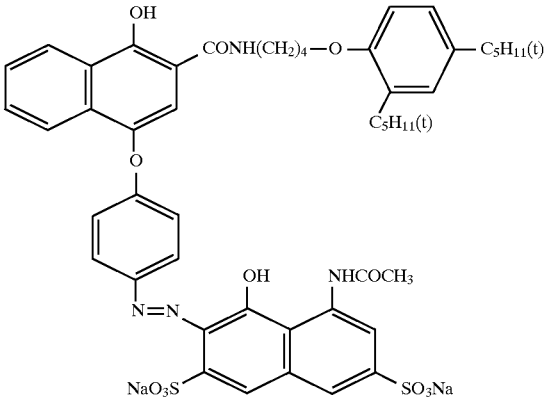
CM-1
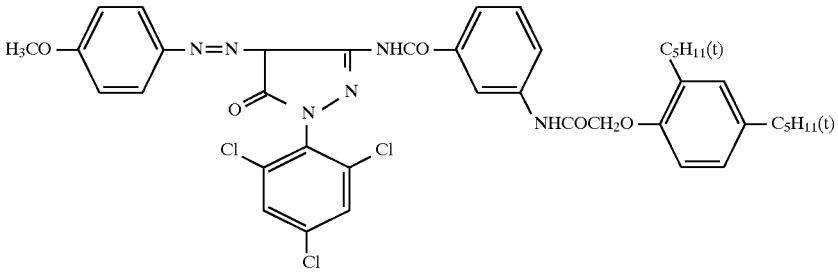
D-1
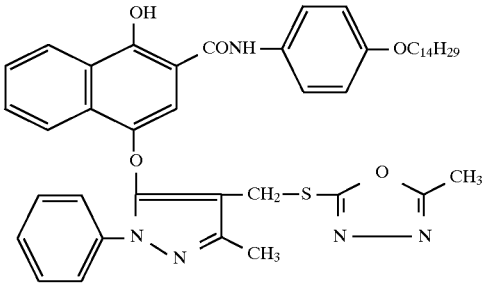

-continued
D-2
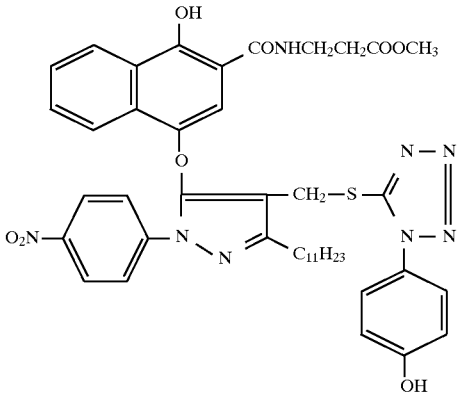
D-3
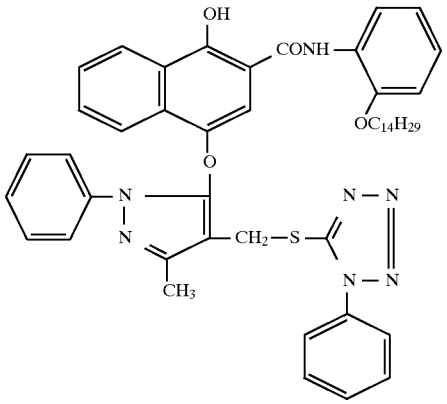
SC-1
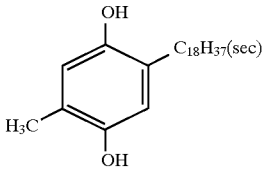
UV-1
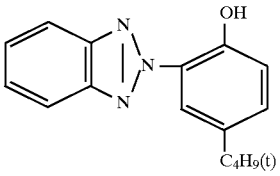
UV-2
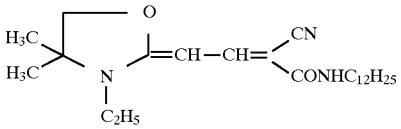
WAX-1
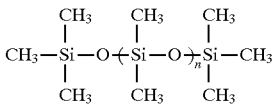
Weight avarage molecular weight: 3,000

-continued
SD-1
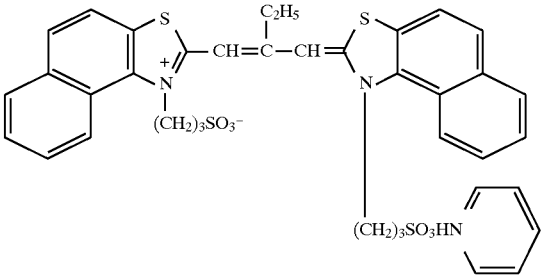
SD-2
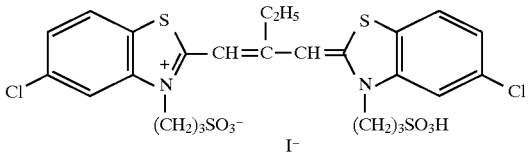
SD-3
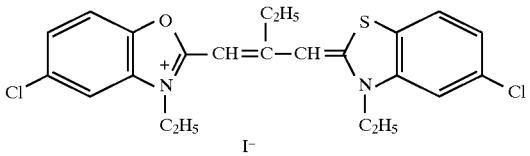
SD-4
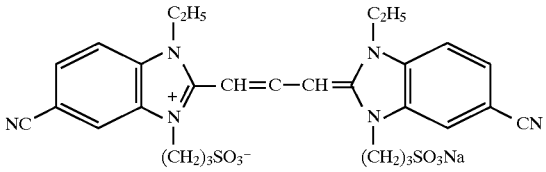
SD-5
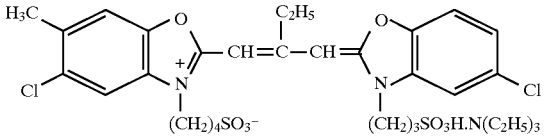
SD-6
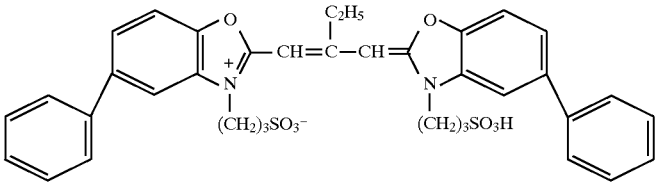
SD-7
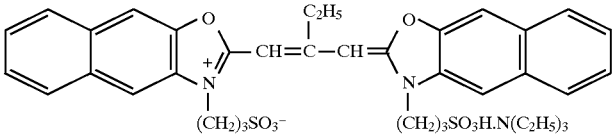
SD-8
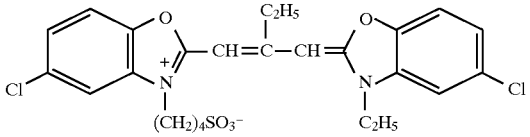
SD-9
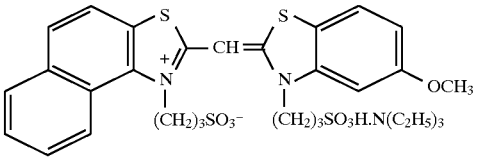

-continued

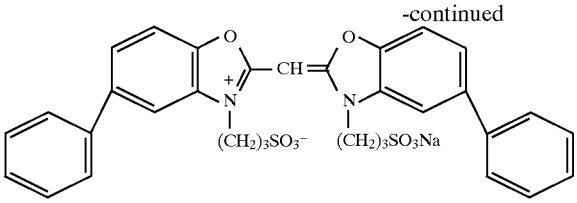

SD-10

In addition to above-described additives were added a coating aid, sodium dioctylsulfosuccinate, dispersing agent sodium tri(isopropyl)naphthalenesulfonate, thickener, hardeners 2,4-dichloro-6-hydroxy-s-triazine sodium salt and di(vinylsulfonylmethyl)ether, stabilizer 4-hydroxy -6-methyl-1,3,3a,7-tetrazaindene, antifoggant 1-phenyl-5-mercaptotetrazole and two poly-N-vinylpyrrolidones each having a weight-averaged molecular weight of 10,000 and 1,100,000.

Samples 101 to 109 were exposed to green light through an optical wedge and processed according to the following steps.

| Processing steps (38° C.) | |
|---|---|
| Color developing | 2 min. 45 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

Composition of processing solution used in each of the above steps is as follows.

| Color developer | |
|---|---|
| 4-Amino-3-methyl-N-(β-hydroxyethyl)aniline sulfate | 4.75 g |
| sodium sulfite anhydride | 4.25 g |
| Hydroxylamine 1/2 sulfate | 2.0 g |
| Potassium carbonate anhydride | 37.5 g |
| Sodium bromide | 1.3 g |
| Trisodium nitrilotriacetate (monohydrate) | 2.5 g |
| potassium hydroxide | 1.0 g |
| Water to make 1 liter (pH - 10.1) | |
| **Bleach** | |
| Ammonium ethylenediaminetetraacetate iron (III) salt | 100.0 g |
| Ammonium ethylenediaminetetraacetate | 10.0 g |
| ammonium bromide | 150 g |
| Glacial acetic acid | 10.0 g |
| Water to make 1 liter | |
| The pH was adjusted to 6.0 with aqueous ammonia solution. | |
| **Fixer** | |
| Ammonium thiosulfate | 175 g |
| Sodium sulfite anhydride | 8.5 g |
| Sodium metasulfite | 2.3 g |
| Water to make 1 liter | |
| The pH was adjusted to 6.0 with acetic acid. | |
| **Stabilizer** | |
| Formalin (37% aqueous solution) | 1.5 ml |
| Koniducks (product by Konica Corp.) | 7.5 ml |
| Water to make 1 liter | |

Thus processed samples were subjected to sensitometry, using green light. The sensitivity was shown as a relative value, based on the sensitivity of sample 101 being 100. Fog was defined in the same manner as in Example 1. Results thereof are shown as below.

| Sample | Emulsion | Sensitivity | Fog | Remark |
|---|---|---|---|---|
| 101 | C-1 | 100 | 0.05 | Comp. |
| 102 | C-2 | 115 | 0.07 | Inv. |
| 103 | C-3 | 120 | 0.07 | Inv. |
| 104 | C-4 | 118 | 0.09 | Inv. |
| 105 | C-5 | 110 | 0.06 | Inv. |
| 106 | C-6 | 125 | 0.08 | Inv. |
| 107 | C-7 | 135 | 0.12 | Inv. |
| 108 | C-8 | 140 | 0.18 | Inv. |
| 109 | C-9 | 115 | 0.39 | Comp. |

From the above results, it is shown that, when the size of the chemical sensitization cluster is controlled and selective growth thereof is attained, a silver halide emulsion with high sensitivity and low fog is obtained and accordingly, a silver halide photographic material containing this emulsion achieved markable improvements in sensitivity and fog.

What is claimed is:

1. A silver halide emulsion comprising silver halide grains, wherein at least 50% of the total number of the grains is accounted for by silver halide grains each having one or more chemical sensitization clusters, a largest size of the clusters being not less than 1.2 nm and less than 4.0 nm.

2. The silver halide emulsion of claim 1, wherein at least 80% of the total number of the grains is accounted for by silver halide grains each having one or more chemical sensitization clusters, a largest size of the clusters being not less than 1.2 nm and less than 4.0 nm.

3. The silver halide emulsion of claim 1, wherein less than 1% of the total number of the grains is accounted for by silver halide grains each having one or more chemical sensitization clusters, a largest size of the clusters being not less than 6 nm.

4. The silver halide emulsion of claim 3, wherein less than 15% of the total number of the grains is accounted for by silver halide grains each having one or more chemical sensitization clusters, a largest size of the clusters being not less than 4 nm and less than 6 nm.

5. A method for preparing a silver halide emulsion comprising the steps of forming a silver halide grain emulsion by mixing an aqueous silver salt solution and aqueous halide solution, and chemically ripening the silver halide emulsion with a chemical sensitizer, wherein, in the step of chemical ripening, the rate of chemical ripening being so controlled that the following requirement is satisfied, $$1.24\times10^2 \leqq \epsilon 1.53\times10^7$$

wherein $\epsilon$ is a relative aggregation rate constant represented by the following equation, $$\epsilon = N\cdot k/(2\cdot ks)$$

wherein N is an addition amount of the chemical sensitizer in number per $\mu m^2$ of the grain surface; k is an aggregation rate constant in $\mu m^2$/min.; and ks is a reaction rate constant of the chemical sensitizer in $min.^{-1}$.

6. The method of claim 5, wherein the chemical ripening is carried out at a temperature of not less than 60° C. and a pAg of not less than 8.5 for at least a period of a time during the step of chemical-ripening.

7. The method of claim 5, wherein the chemical ripening is carried out so as to form the chemical sensitization clusters at a specific site of the grain.

* * * * *